US006516071B1

(12) United States Patent
Liu

(10) Patent No.: US 6,516,071 B1
(45) Date of Patent: Feb. 4, 2003

(54) STRUCTURE OF A PICTURE-FRAME TYPE LOUDSPEAKER

(75) Inventor: Yu Tsao Liu, Taipei (TW)

(73) Assignee: Reui Men Co., Ltd., Taipei Hsien (TW)

( * ) Notice: Subject to any disclaimer, the term of this patent is extended or adjusted under 35 U.S.C. 154(b) by 0 days.

(21) Appl. No.: 09/961,148

(22) Filed: Sep. 24, 2001

(51) Int. Cl.[7] ..... H04R 25/00

(52) U.S. Cl. ..... 381/152; 381/386; 381/403; 381/423

(58) Field of Search ..... 381/396, 398, 381/403, 420, 423, 432, 152, 424, 386, 425; 181/171, 172

(56) References Cited

U.S. PATENT DOCUMENTS 3,848,090 A * 11/1974 Walker ..... 381/152
4,122,314 A * 10/1978 Matsuda et al. ..... 381/425
4,472,604 A * 9/1984 Nakamura et al. ..... 381/425

FOREIGN PATENT DOCUMENTS

FR 2542549 * 9/1984 ..... 381/152

* cited by examiner

*Primary Examiner*—Huyen Le
(74) *Attorney, Agent, or Firm*—Leong C. Lei

(57) ABSTRACT

An improved structure of a picture-frame type loudspeaker is disclosed. The loudspeaker structure having a magnetic core is mounted on a housing body adhered to the rear side of a picture frame, and the circumferential edge of the magnetic core is mounted with a conduit containing a voice coil, and the end section of the conduit, close to the magnetic core is connected together with a corrugation portion which is combined with the housing body, the middle section of the conduit is connected to a diaphragm and the other end of the conduit is connected to a vibration board within the picture frame via a medium. By means of the reaction to the signal current by the voice coil, a magnetic field is produced and a relative motion is formed with the magnetic core, such that the vibration board vibrates to produce sound from the picture frame.

1 Claim, 3 Drawing Sheets

STRUCTURE OF A PICTURE-FRAME TYPE LOUDSPEAKER

BACKGROUND OF THE INVENTION (a) Field of the Invention

The present invention relates to an improved structure of a loudspeaker, and in particular, an improved structure of a picture-frame loudspeaker of high sensitivity m sound producing.

(b) Description of the Prior Art

As shown in FIG. 1, there is shown a conventional flat-type loudspeaker. A magnetic core-52 is mounted within a housing body 51 (center), and the upper circumferential edge of the magnetic core 52 is mounted with a conduit 53 containing a voice coil 531 (solenoid). The conduit 53, closing to the end portion of the magnetic core 52, is combined with a corrugation portion 533 having an outward wave-like shape, and the other end of the conduit 53 is mounted to a medium 532 which is adhered to the surface of a vibration board 5. The output signal of an amplifier is inputted into the voice coil 531 so that a magnetic field is produced to attract the magnetic core 52, and the conduit 53 and the magnetic core 52 produce a reciprocating movement. The medium 532 pushes the vibration board 5 to vibrate air to produce sound. The drawbacks of this conventional structure are that a. The vibration board 5 has a large mass inertia, and therefore a low driving current will not sufficient to cause the vibration board 5 to produce vibration. As a result, the sound producing sensitivity of the entire loudspeaker is low.

b. Due to the large mass inertia of the vibration board 5, the energy attenuation rate is relative large, and if the position of the medium 532 on the vibration board 5 is not appropriate, the entire level of vibration is not even, and therefore, the sound quality of sound-producing of the loudspeaker is poor.

c. Due to the large mass inertia of the vibration board 5, the conduit 53 needs an extremely large driving force, and the conduit 53 is only supported by the corrugation portion 533, thus, if a large sound is to be outputted, the conduit 53 will become tilting, and the output may be distorted. If the distortion is too serious, the loudspeaker may be damaged.

In view of the above drawbacks, it is on object of the present invention to provide an improved structure of a picture-frame type loudspeaker, which mitigates the above drawbacks.

SUMMARY OF THE INVENTION

Accordingly, it is an object of the present invention to provide an improved structure of a picture-frame type loudspeaker, wherein a magnetic core is mounted on a housing body adhered to the rear side of a picture frame, and the circumferential edge of the magnetic core is mounted with a conduit containing a voice coil, and the end section of the conduit, close to the magnetic core, is connected together with a corrugation portion which is combined with the housing body, the middle section of the conduit is connected to a diaphragm and the other end of the conduit is connected to a vibration board within the picture frame via a medium By means of the reaction to the signal current by the voice coil, a magnetic field is produced and a relative movement is formed with the magnetic core, such that the vibration board vibrates to produce sound from the picture frame.

Yet another object of the present invention to provide an improved structure of a picture-frame type loudspeaker, wherein the circumferential edge of the diaphragm is connected to the housing body via a second corrugation portion extended from the diaphragm, such that a support is formed together with a first corrugation portion and the conduit so as to minimize tilting during the movement of the conduit.

Yet a further object of the present invention to provide an improved structure of a picture-frame type loudspeaker, wherein the sound producing sensitivity of the loudspeaker is greatly improved.

The foregoing object and summary provide only a brief introduction to the present invention. To filly appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

Figure 1:
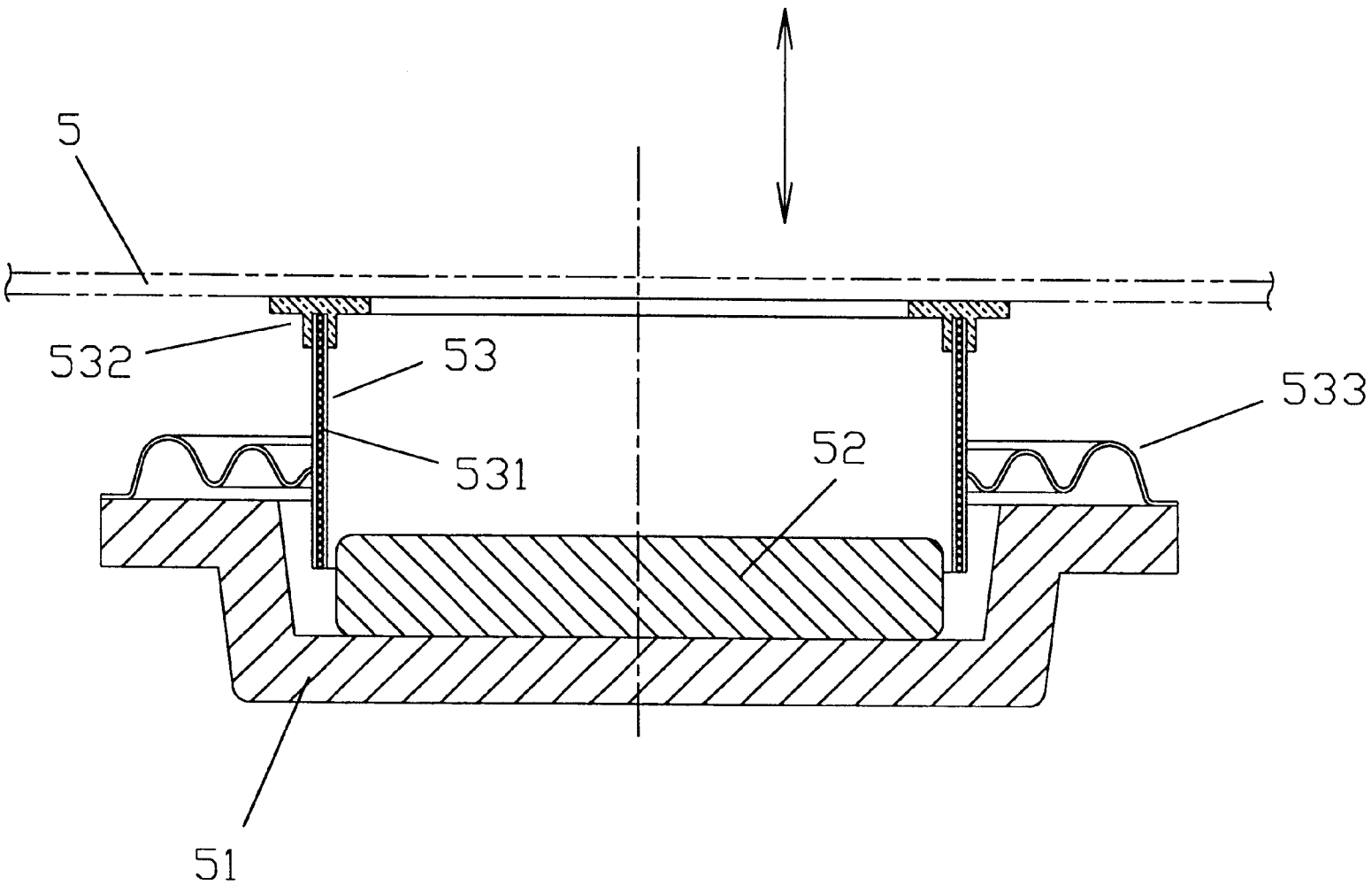
PRIOR ART FIG. 1
FIG. 1 is a sectional view of a conventional flat-board type loudspeaker structure.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 2:
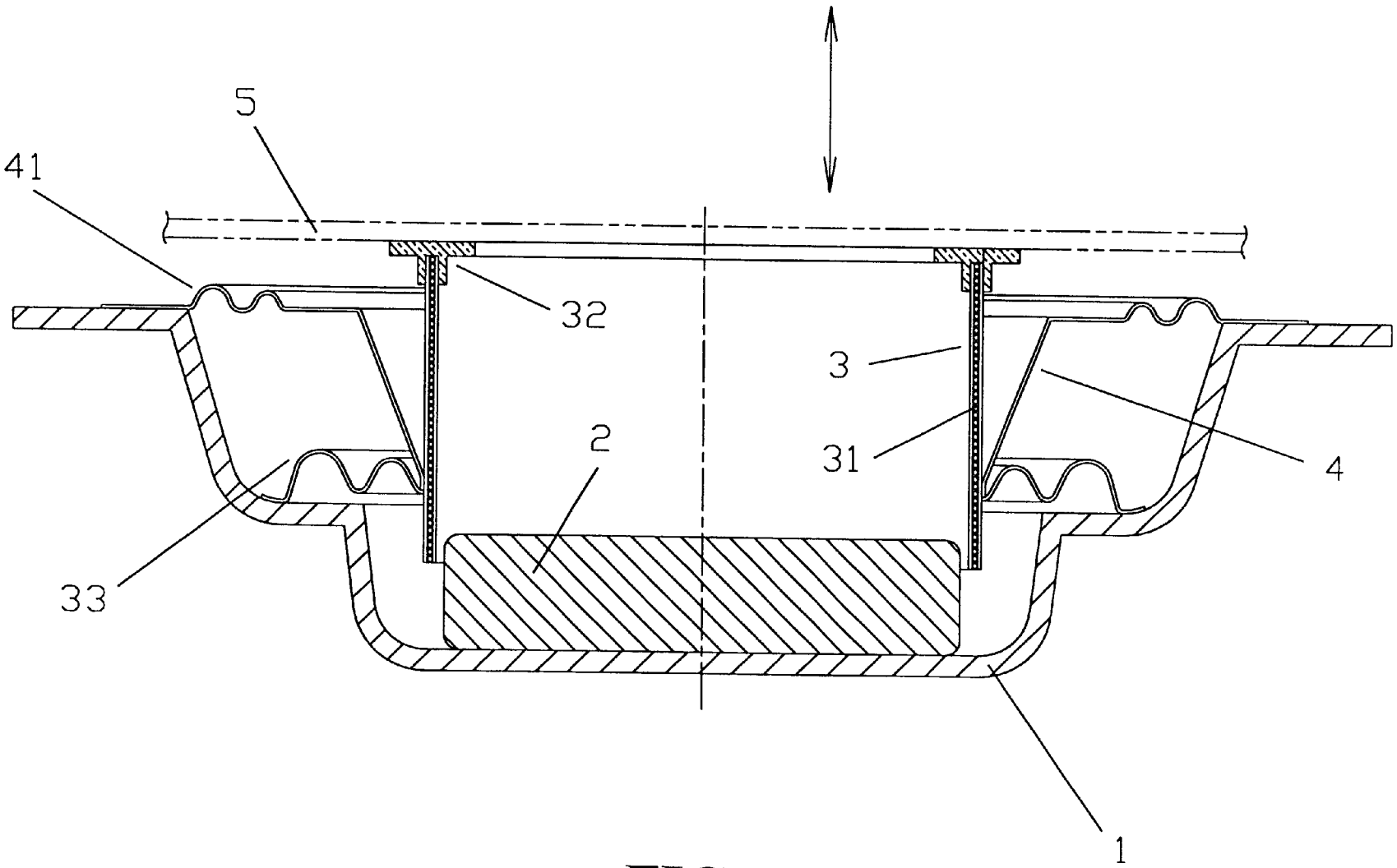
FIG. 2 is a sectional view of an improved structure of a picture-frame type loudspeaker in accordance with the present invention.
Figure 3:
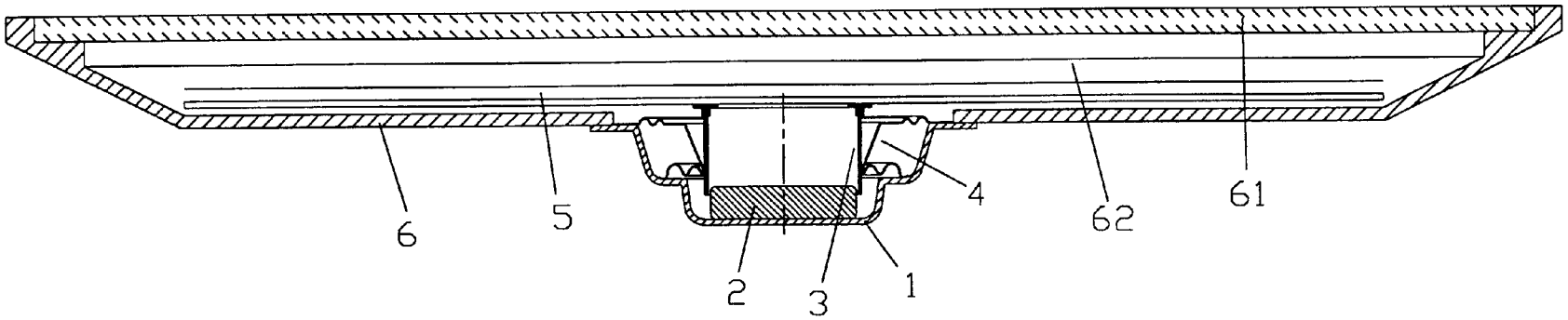
FIG. 3 is a sectional view of an improved structure of a picture-frame type loudspeaker, wherein the loudspeaker is mounted together with the picture frame.

Referring to FIG. 2, there is shown an improved structure of a picture-frame type loudspeaker, comprising a housing body 1, a magnetic core 2, a conduit 3 and a diaphragm 4, wherein the housing body 1 is adhered at the rear side of a picture frame 6. The magnetic core 2 is mounted within the housing 1 (center) and the conduit 3 is a hollow cylindrical shape. On the circumferential edge of the magnetic core 2 and within the conduit 3, a voice coil 31 is wound, and the end portion of the conduit 3, close to the magnetic core 2, is mounted together with a first corrugation portion 33, and the diaphragm 4. The first corrugation portion 33 is wave-like shape and is extended outward to the inner side of the housing body 1. The external circumferential edge of the diaphragm 4 has a second corrugation portion 41 having a wave-like cross-section and is extended to the housing 1. The other end of the conduit 3 is mounted to a medium 32, which is adhered to a vibration board 5 within the picture frame 6.

In application, the output signal of the amplifier is input to the voice coil 31 so that the produced magnetic field will mutually attract the magnetic core 2, and this causes a relative reciprocation movement of the conduit 3 and the magnetic core 2. By means of the medium 32 to simultaneously push the vibration board 5, the diaphragm 4 vibrates the air to produce a special effect from the picture frame 6. As the diaphragm 4 has a smaller mass inertia, the sensitivity of sound producing is greatly improved. The diaphragm 4 and the second corrugation portion 41 can match with the first corrugation portion 33 to form a support for the conduit 3. This will effectively reduce the tilting formed as a result of the movement of the conduit 3.

In accordance with the present invention, a special sound effect is produced from the picture frame and the sensitivity of sound producing is greatly improved It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of a picture-frame type loudspeaker having a magnetic core mounted on a housing body adhered to the rear side of a picture frame, the circumferential edge of the magnetic core being mounted with a conduit containing a voice coil therein, the end section of the conduit close to the magnetic core being connected together with a first corrugation portion extended outward to the housing body, characterized in that the circumferential edge of the conduit between the first corrugation portion and a vibration board is provided with a diaphragm mounted with the housing body, and the other end of the conduit is connected with the vibration board provided within the picture frame, wherein a second corrugation portion having a wave-shaped sectional area is provided between the circumferential edge of the diaphragm and the housing body.

* * * * *